US010088772B2

(12) United States Patent
Terada et al.

(10) Patent No.: US 10,088,772 B2
(45) Date of Patent: Oct. 2, 2018

(54) DEVELOPING DEVICE

(71) Applicant: CANON KABUSHIKI KAISHA, Tokyo (JP)

(72) Inventors: Ryohei Terada, Matsudo (JP); Ichiro Katsuie, Takasaki (JP); Shoji Naruge, Kashiwa (JP); Masahiro Ootsuka, Tokyo (JP); Tatsuya Inoue, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/873,261

(22) Filed: Jan. 17, 2018

(65) Prior Publication Data

US 2018/0210369 A1 Jul. 26, 2018

(30) Foreign Application Priority Data

Jan. 20, 2017 (JP) ..... 2017-008868

(51) Int. Cl.

*G03G 15/08* (2006.01)
*G03G 15/09* (2006.01)
*G03G 15/01* (2006.01)

(52) U.S. Cl.

CPC ..... *G03G 15/0812* (2013.01); *G03G 15/0121* (2013.01); *G03G 15/087* (2013.01); *G03G 15/09* (2013.01)

(58) Field of Classification Search

CPC ..... G03G 15/0812; G03G 15/0121; G03G 15/087; G03G 15/09

See application file for complete search history.

(56) References Cited

U.S. PATENT DOCUMENTS

| | | | | |
|---|---|---|---|---|
| 5,682,585 | A | 10/1997 | Yamaguchi et al. | |
| 5,781,835 | A | 7/1998 | Okano et al. | |
| 8,385,754 | B2 * | 2/2013 | Hirobe | G03G 15/0893 399/119 |
| 9,348,255 | B2 | 5/2016 | Kanai et al. | |
| 2014/0169839 | A1 * | 6/2014 | Nakayama | G03G 15/0921 399/274 |
| 2018/0074433 | A1 * | 3/2018 | Sakamaki | G03G 15/09 |

FOREIGN PATENT DOCUMENTS

| | | | |
|---|---|---|---|
| JP | 2006-184451 | A | 7/2006 |
| JP | 2007-286207 | A | 11/2007 |
| JP | 2009-265360 | A | 11/2009 |
| JP | 2009265358 | A * | 11/2009 |
| JP | 2015-057624 | A | 3/2015 |

* cited by examiner

*Primary Examiner* — Francis C Gray
(74) *Attorney, Agent, or Firm* — Fitzpatrick, Cella, Harper & Scinto

(57) ABSTRACT

A developing device includes a rotatable developer carrying member enclosing a magnetic field generating portion including a plurality of magnetic poles and configured to carry a developer; and a resinous regulating portion provided at a position opposing the developer carrying member and configured to regulate an amount of the developer carried by the developer carrying member. The regulating portion is formed of a resin material containing magnetic powder, and at least a free end portion, opposed to the developer carrying member, of the regulating portion has relative permeability of 10 or more and 60 or less.

6 Claims, 10 Drawing Sheets

DEVELOPING DEVICE

FIELD OF THE INVENTION AND RELATED ART

The present invention relates to a developing device used in an image forming apparatus of an electrophotographic type or an electrostatic recording type.

Conventionally, in the image forming apparatus of the electrophotographic type or the electrostatic recording type, a developing device for developing an electrostatic latent image, formed on an image bearing member, with a two-component developer (hereinafter simply referred to as a "developer") including toner and a carrier.

The developing device includes a developer carrying member for carrying and feeding the developer and a regulating member for regulating an amount of the developer fed to an opposing portion (developing portion) to an image bearing member by the developer carrying member. Conventionally, as a material of the regulating member, a metal material such as aluminum alloy or stainless steel as a non-magnetic material is used in many cases. On the other hand, in order to reduce a cost of the developing device, formation of a regulating member with use of a resin material has been proposed (Japanese Laid-Open Patent Application 2015-57624).

However, in the developing device including the regulating member formed of the resin material, the following problem to be solved exists.

That is, the regulating member formed using the resin material is liable to generate twist (torsion) due to an error in position of both ends of the developing device with respect to a longitudinal direction when the developing device is assembled in an image forming apparatus. Further, the regulating member formed using the resin material is liable to generate deflection (flexure) at a longitudinal central portion thereof due to a pressure by a developer. When the distortion or the deflection generates, a relative positional relationship between the regulating member and magnetic poles of a magnetic field generating means incorporated in the developer carrying member changes, and a regulation state of an amount of the developer by the regulating member changes, so that an amount of the developer fed toward the developing portion changes. In order to eliminate the distortion and the deflection, when strength of the regulating member is enhanced, there is a liability that a constitution including the resin material becomes complicated.

SUMMARY OF THE INVENTION

A principal object of the present invention is to provide a developing device capable of stabilizing an amount of a developer carried and fed by a developer carrying member with a simple constitution including a regulating member formed of a resin material.

According to an aspect of the present invention, there is provided a developing device comprising: a rotatable developer carrying member enclosing a magnetic field generating portion including a plurality of magnetic poles and configured to carry a developer; and a resinous regulating portion provided at a position opposing the developer carrying member and configured to regulate an amount of the developer carried by the developer carrying member, wherein the regulating portion is formed of a resin material containing magnetic powder, and at least a free end portion, opposed to the developer carrying member, of the regulating portion has relative permeability of 10 or more and 60 or less.

Further features of the present invention will become apparent from the following description of exemplary embodiments with reference to the attached drawings.

Figure 6:
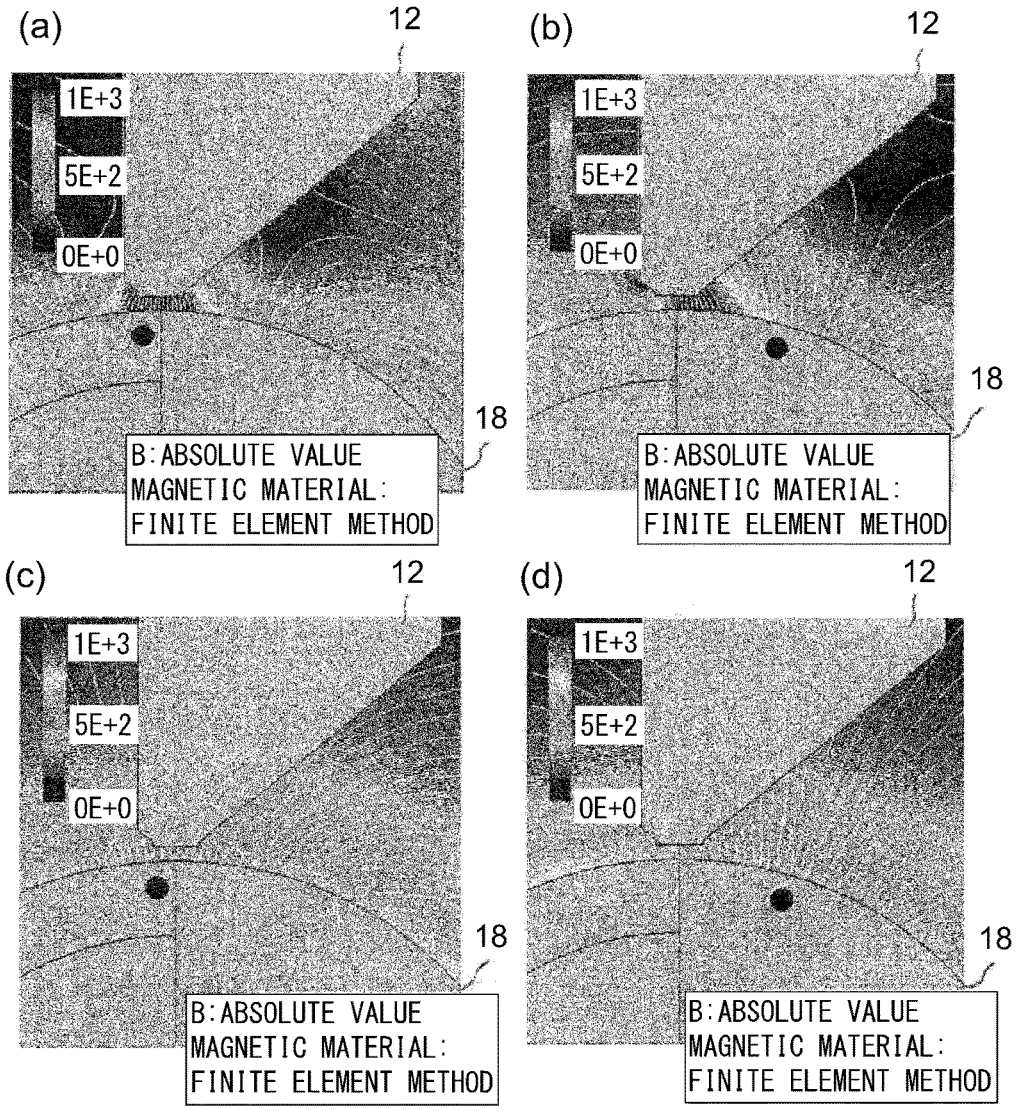

Parts (a) to (d) of FIG. 6 are schematic views each showing magnetic lines of force in the neighborhood of a cut pole in a magnetic field analysis.

Figure 7:
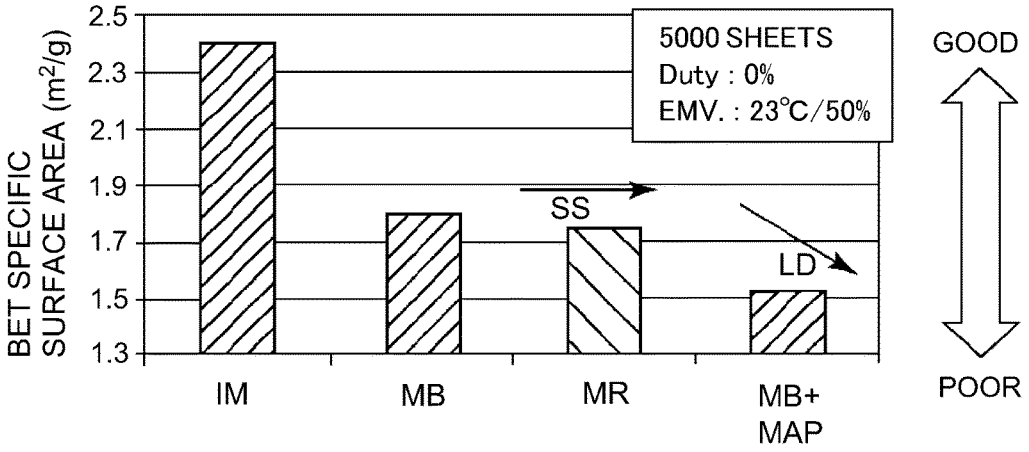

FIG. 7 is a graph showing a result of evaluation of a degree of toner deterioration.

Figure 8:
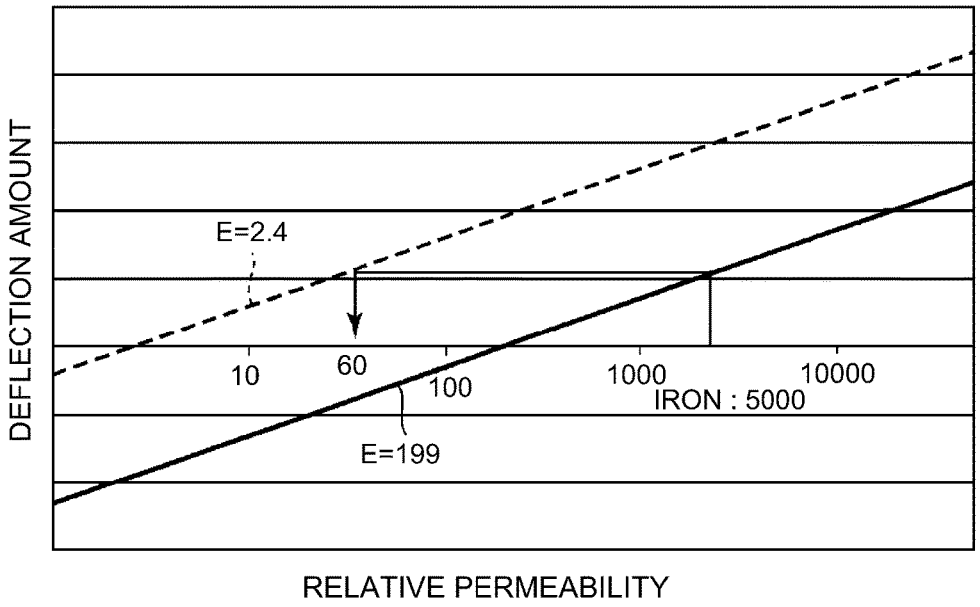

FIG. 8 is a graph showing a relationship between relative permeability and a deflection amount.

Figure 9:
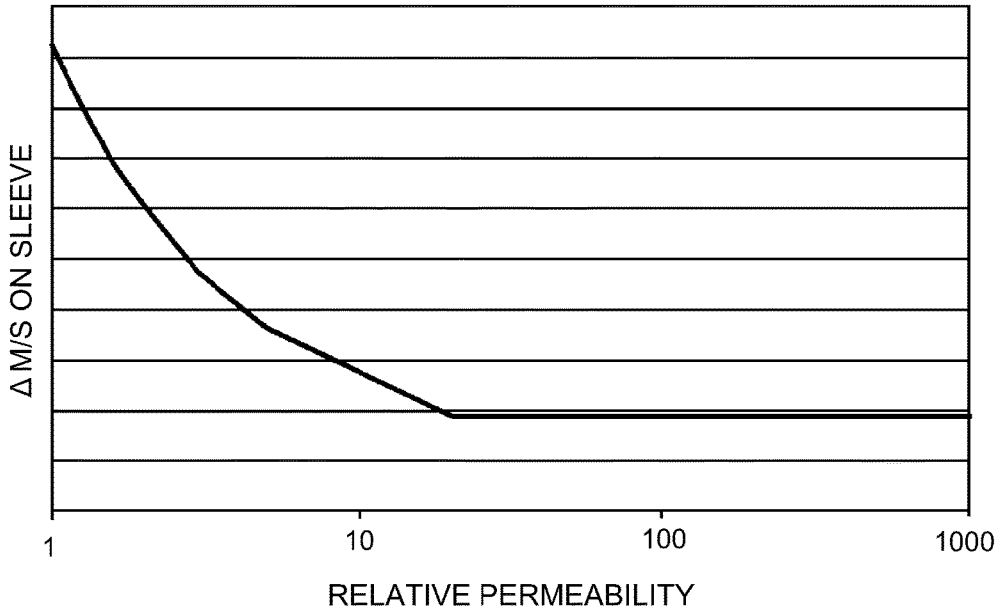

FIG. 9 is a graph showing a relationship between the relative permeability and a change amount ΔM/S of a carrying amount.

Figure 10:
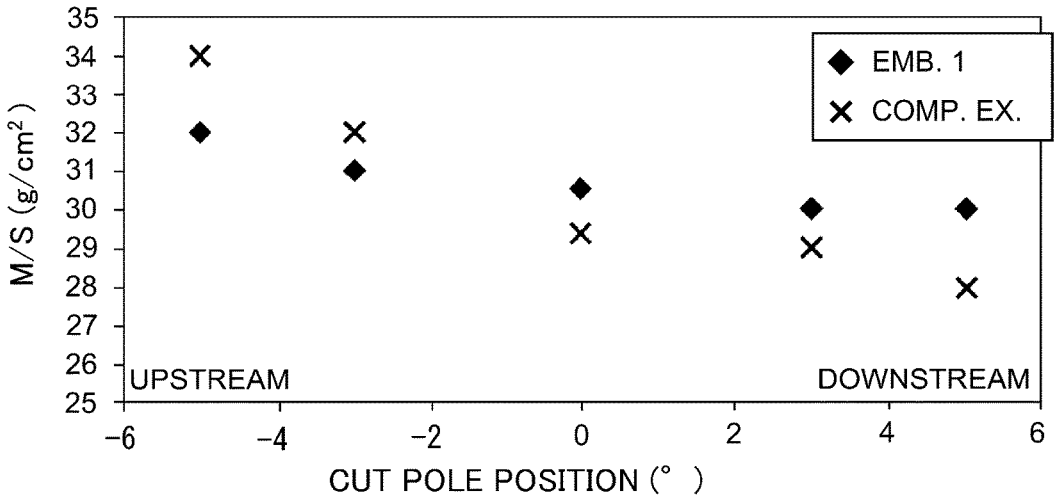

FIG. 10 is a graph showing an effect of Embodiment 1.

Figure 11:
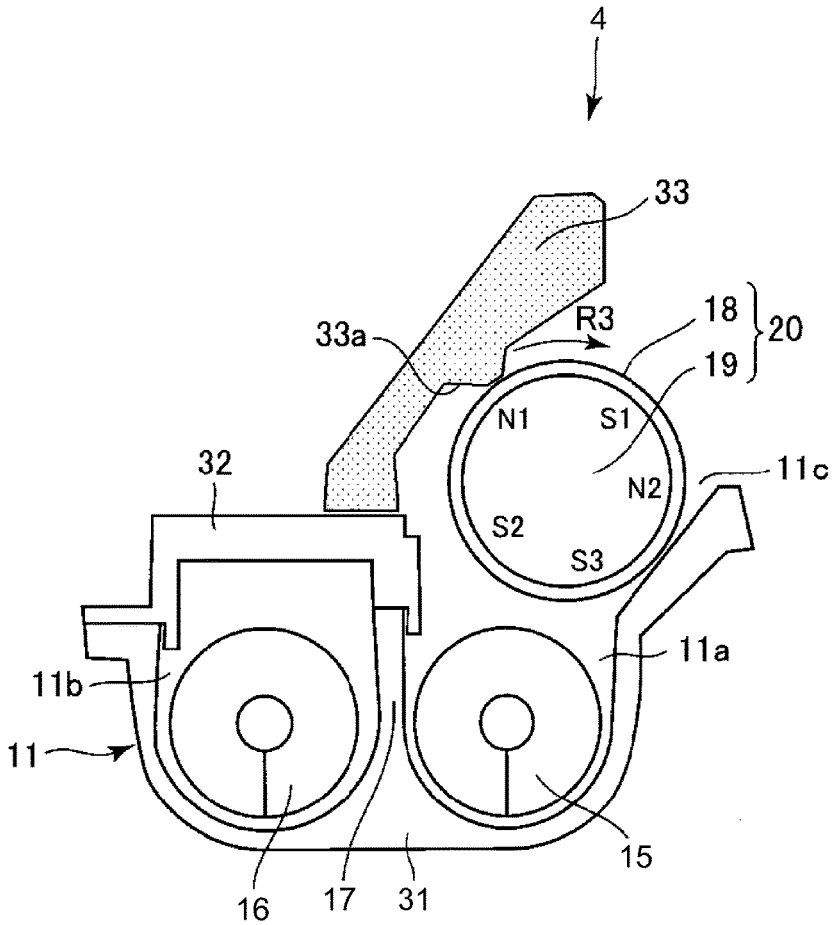

FIG. 11 is a sectional view of a developing device in another embodiment.

Figure 12:
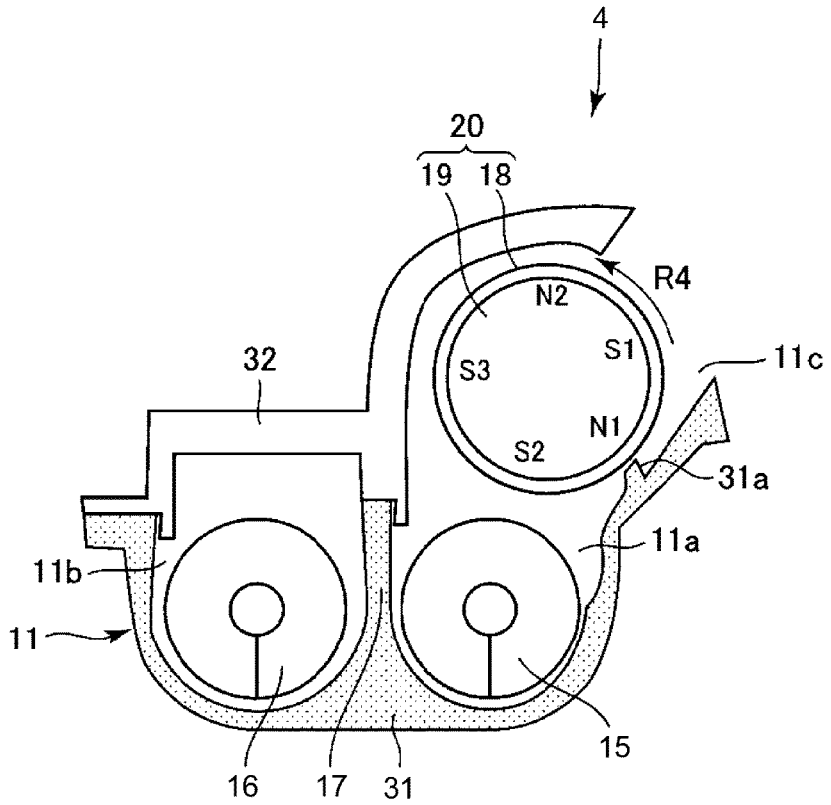

FIG. 12 is a sectional view of another example of the developing device in another embodiment.

Figure 13:
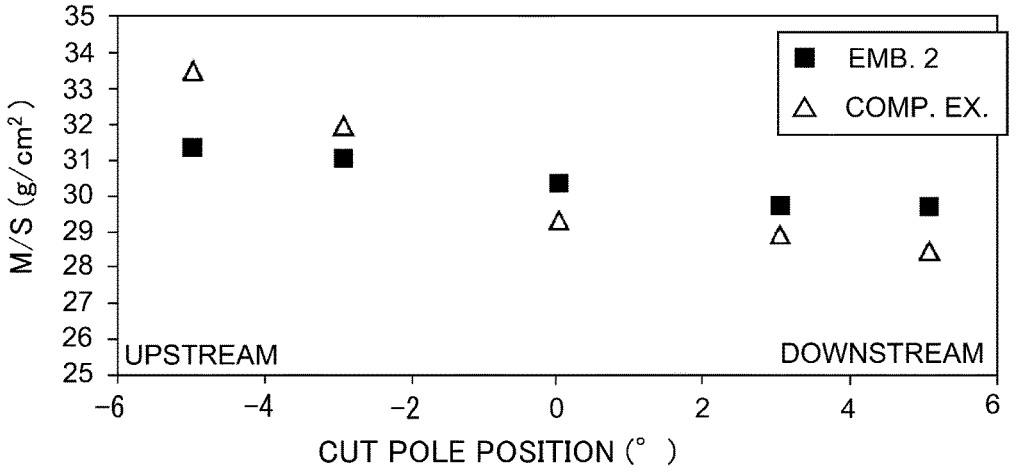

FIG. 13 is a graph showing an effect of Embodiment 2.

DESCRIPTION OF EMBODIMENTS

A developing device according to the present invention will be described with reference to the drawings.

Embodiment 1

1. General Constitution and Operation of Image Forming Apparatus

Figure 1:
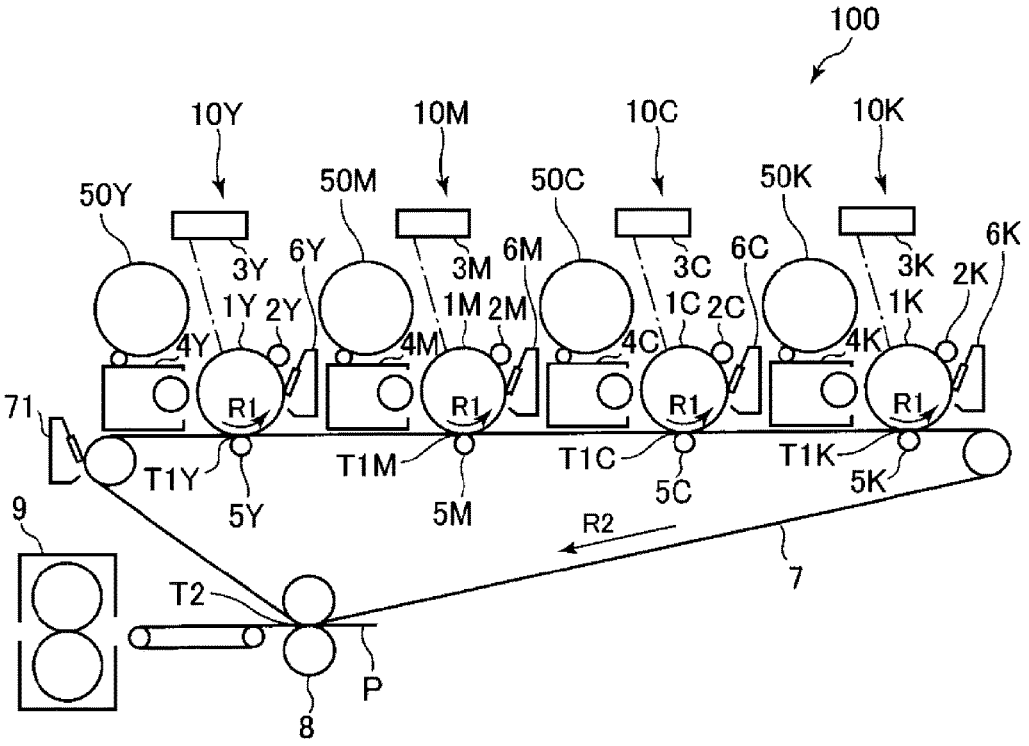
FIG. 1 is a sectional view of an image forming apparatus.

FIG. 1 is a schematic sectional view of an image forming apparatus 100 in this embodiment.

The image forming apparatus 100 in this embodiment is a tandem-type laser beam printer which is capable of forming a full-color image by using an electrophotographic type and which employs an intermediary transfer type.

The image forming apparatus 100 includes, as a plurality of image forming portions (stations), first to fourth image forming portions 10Y, 10M, 10C and 10K for forming toner images of yellow (Y), magenta (M), cyan (C) and black (Bk), respectively. In this embodiment, constitutions and operations of the respective image forming portions 10Y, 10M, 10C and 10K are substantially the same except that colors of toners used in a developing step described later and different from each other. Accordingly, in the case where particular distinction is not needed, suffixes Y, M, C and K representing elements for associated colors are omitted, and the elements will be collectively described. In this embodiment, the image forming portion 10 is constituted by including a photosensitive drum 1, a charging roller 2, an exposure device 3, a developing device 4, a primary transfer roller 5, a drum cleaning device 6, and the like, which are described later.

The photosensitive drum 1 which is a drum-shaped (cylindrical) electrophotographic photosensitive member as an image bearing member is rotationally driven in an indicated arrow R1 direction (counterclockwise direction) in FIG. 1. A surface of the rotating photosensitive drum 1 is electrically charged uniformly to a predetermined polarity (negative in this embodiment) and a predetermined potential by the charging roller 2 which is a roller-shaped charging member as a charging means. The surface of the charged photosensitive drum 1 is subjected to scanning exposure to light by the exposure device (laser scanner) 3 as an exposure means in accordance with image information, so that an electrostatic latent image (electrostatic image) is formed on the photosensitive drum 1. The electrostatic image formed on the photosensitive drum 1 is developed (visualized) with a developer by the developing device 4 as a developing means, so that the toner image is formed on the photosensitive drum 1.

In this embodiment, the toner charged to the same polarity (negative in this embodiment) as the charge polarity of the photosensitive drum 1 is deposited on an exposed portion of the photosensitive drum 1 which is lowered in absolute value of the potential by the exposure to light after the photosensitive drum 1 is charged uniformly.

An intermediary transfer belt 7, constituted by an endless belt, as an intermediary transfer member is provided opposed to the respective photosensitive drums 1 of the image forming portions 10. The intermediary transfer belt 7 is extended around a plurality of stretching rollers, and the driving roller which is one of the plurality of stretching rollers is rotationally driven, whereby the intermediary transfer belt 7 is rotated (circulated and moved) in an arrow R2 direction (clockwise direction) in FIG. 1. In an inner peripheral surface side of the intermediary transfer belt 7, primary transfer rollers 5 which are roller-type primary transfer members as primary transfer means are provided correspondingly to the photosensitive drums 1. Each of the primary transfer rollers 5 is pressed (urged) against the intermediary transfer belt 7 toward the photosensitive drum 1, so that a primary transfer portion T1 where the photosensitive drum 1 and the intermediary transfer belt 7 contact each other. The toner image formed on the photosensitive drum 1 as described above is primary-transferred onto the intermediary transfer belt 7 by the primary transfer roller 5 with use of a pressure and an electrostatic force. For example, during full-color image formation, the respective color toner images of yellow, magenta, cyan and black formed on the respective photosensitive drums 1 are successively primary-transferred superposedly onto the intermediary transfer belt 7.

At a position opposing a secondary transfer opposite roller, which is one of the plurality of stretching rollers for the intermediary transfer belt 7, provided on an outer peripheral surface side of the intermediary transfer belt 7, a secondary transfer roller 8 which is a roller-type secondary transfer member as a secondary transfer means is disposed. The secondary transfer roller 8 is pressed (urged) against the intermediary transfer belt 7 toward the secondary transfer opposite roller and forms a secondary transfer portion T2 where the intermediary transfer belt 7 and the secondary transfer roller 8 are in contact with each other. The toner images formed on the intermediary transfer belt 7 as described above are secondary-transferred, using a pressure and an electrostatic force, onto the recording material P, such as a recording sheet, nipped and fed at the secondary transfer portion T2 by the intermediary transfer belt 7 and the secondary transfer roller 8. The recording material P is timed to the toner images on the intermediary transfer belt 7 by a feeding device (not shown) and is fed to the secondary transfer portion T2 by the feeding device.

The recording material P on which the toner images are transferred is fed to a fixing device 9 as a fixing means, and the toner images are fixed on the surface of the recording material P under application of heat and pressure, and thereafter, the recording material P is discharged to an outside of an apparatus main assembly of the image forming apparatus 100.

On the other hand, the toner (primary transfer residual toner) remaining on the surface of the photosensitive drum 1 after the primary transfer is removed and collected from the surface of the photosensitive drum 1 by a drum cleaning device 6 as a photosensitive member cleaning means.

Further, the toner (secondary transfer residual toner) remaining on the surface of the intermediary transfer belt 7 after the secondary transfer is removed and collected from the surface of the intermediary transfer belt 7 by a belt cleaning device 71 as an intermediary transfer member cleaning means.

2. General Structure of Developing Device

Figure 2:
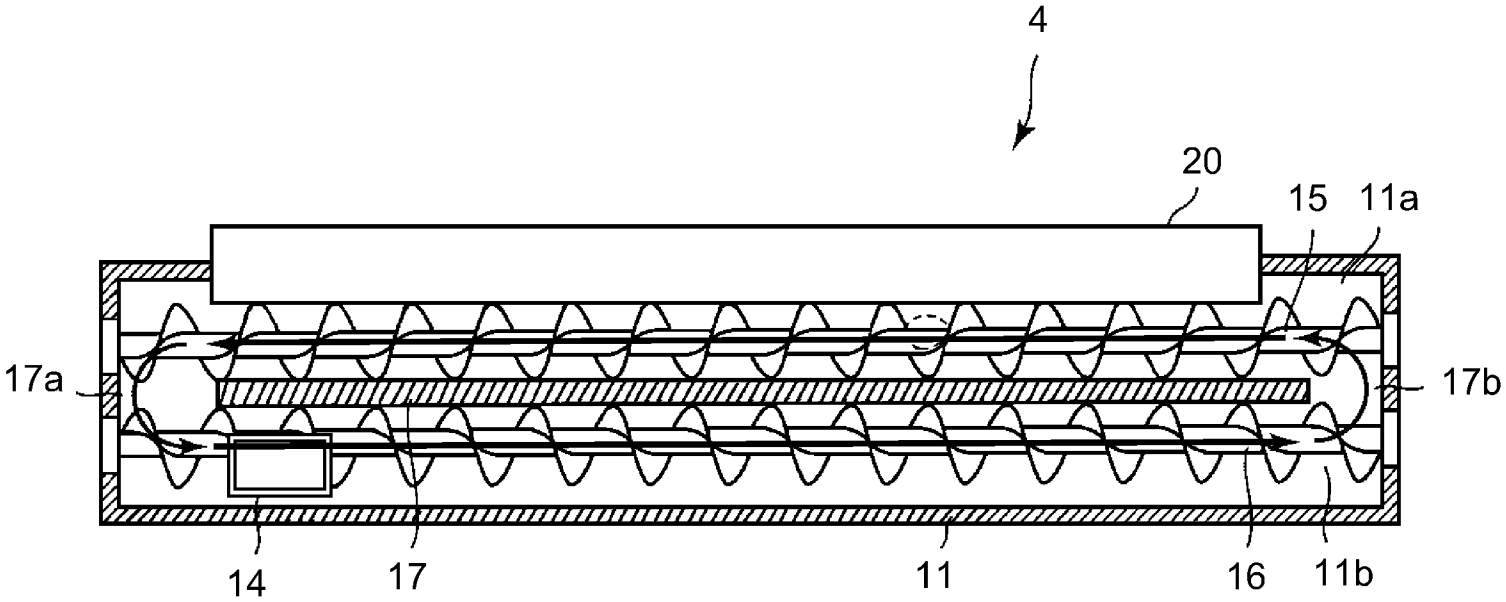
FIG. 2 is a top (plan) view of an inside of a developing device.
Figure 3:
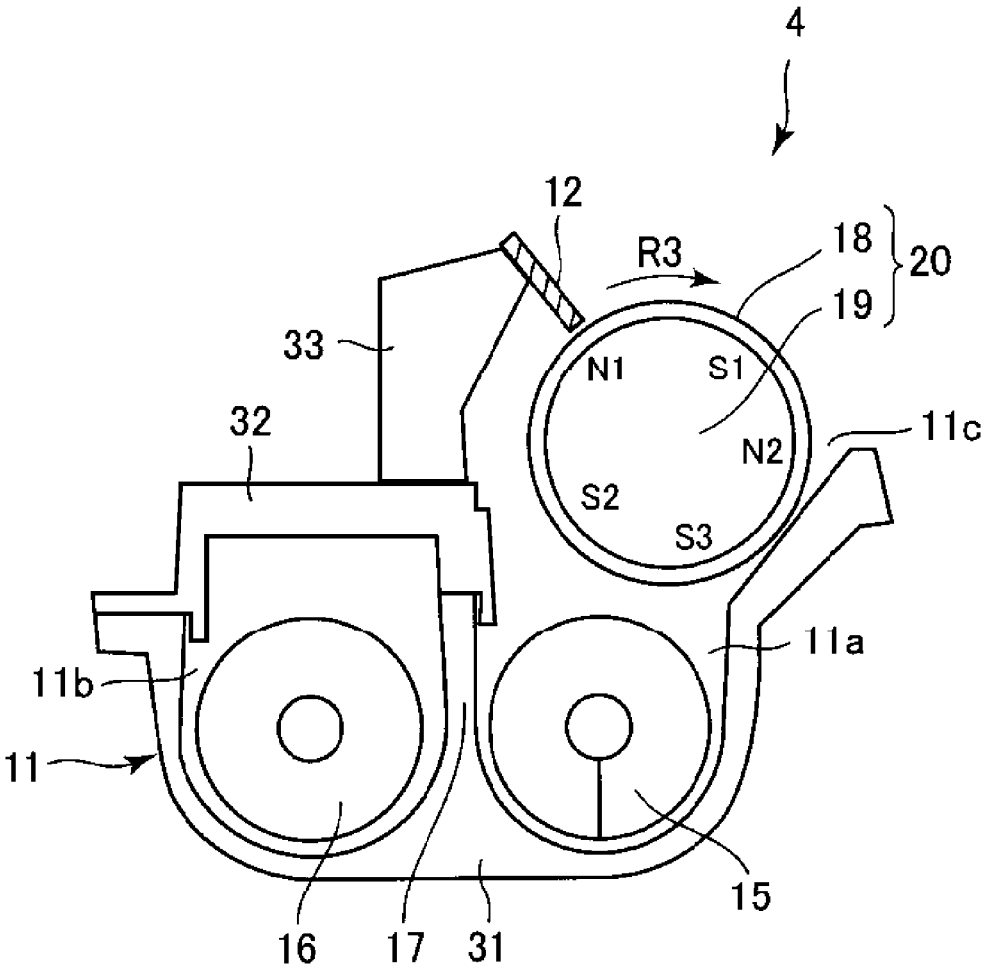
FIG. 3 is a sectional view of the developing device.

FIG. 2 is a schematic top (plan) view of an inside of the developing device 4 in this embodiment. FIG. 3 is a sectional view of the developing device 4 in this embodiment. The developing device 4 in this embodiment is a developing device of a two-component contact development type.

The developing device 4 includes a developing container 11 which accommodates, as the developer, a two-component developer in which the toner which is a colored resin material and a carrier which is magnetic particles are mixed with each other. In this embodiment, the toner which is formed of a polyester resin material and which has a volume-average particle size of 6.0 μm, and the carrier which is formed using (oxide) ferrite and a binder resin (material) and which has a volume-average particle size of 50 μm are used. In this embodiment, a mixing ratio between the toner and the carrier is a proportion of a weight of the toner to a weight of the developer (hereinafter also referred to as a toner content (concentration), and is 10.0%.

An inside of the developing container 11 is divided into a developing chamber 11*a* and a stirring chamber 11*b* by a partition wall 17. The partition wall 17 extends substantially in parallel to a rotational axis direction of the photosensitive drum 1 at a central portion of the developing container 11 with respect to a direction substantially perpendicular to the rotational axis direction of the photosensitive drum 1. In the developing chamber 11*a*, a first feeding screw 15 as a feeding member is provided, and in the stirring chamber 11*b*, a second feeding screw 16 as a feeding member is provided. Each of the first and second feeding screws 15 and 16 is rotatably supported by the developing container 11. Each of the first and second feeding screws 15 and 16 is constituted by forming a helical blade around a rotation shaft. The rotational axis directions of the first and second feeding screws 15 and 16 are substantially parallel to the rotational axis direction of the photosensitive drum 1. The first and second feeding screws 15 and 16 are rotated by transmission of a driving force thereto from a driving source provided in the apparatus main assembly of the image forming apparatus 100, and feed the developer in the developing chamber 11*a* and the stirring chamber 11*b*, respectively.

The first and second feeding screws 15 and 16 feed the developer in opposite directions to each other along their rotational axis directions. Further, at both end portions of the partition wall 17 with respect to a longitudinal direction of the partition wall 17, first and second communicating portions 17*a* and 17*b* which are openings each enabling delivery of the developer between the developing chamber 11*a* and the stirring chamber 11*b* are provided. The developer fed in the developing chamber 11*a* from a right side to a left side in FIG. 2 by the first feeding screw 15 is delivered to the stirring chamber 11*b* through the first communicating portion 17*a*. The developer fed in the stirring chamber 11*b* from a left side to a right side in FIG. 2 by the second feeding screw 16 is delivered to the developing chamber 11*a* through the second communicating portion 17*b*. Thus, the developer is circulated in the developing container 11 so as to be rotated (moved) in a certain direction. The developer is fed by the first and second feeding screws 15 and 16 while being stirred by the first and second feeding screws 15 and 16, whereby the surfaces of the toner and the carrier rub against each other. As a result, in this embodiment, the toner is negatively charged and the carrier is positively charged, so that the toner is deposited on the surface of the carrier.

At a position, of the developing container 11, opposing the photosensitive drum 1, a developing (container) opening 11*c* is provided. A developing roller 20 as a developer carrying member is provided so that a part thereof is exposed to an outside of the developing container 11 through the developing opening 11*c*. The developing roller 20 is an example of a rotatable developer carrying member which includes a magnetic field generating portion including a plurality of magnetic poles and which carries and feeds the developer. The developing roller 20 is constituted by including a developing sleeve 18 as a hollow cylindrical developer carrying portion and a magnet roller 19 as a magnetic field generating portion provided inside (at a hollow portion of) the developing sleeve 18. The developing sleeve 18 is rotatably supported by the developing container 11. A rotational axis direction of the developing sleeve 18 is substantially parallel to the rotational axis direction of the photosensitive drum 1. The developing sleeve 18 is rotated by transmission of the developing force thereto from the driving source provided in the apparatus main assembly of the image forming apparatus 100. The magnet roller 19 is supported by the developing container 11 so that the magnet roller 19 cannot rotate. Further, a developing blade 12 as a regulating portion is provided so as to oppose the developing sleeve 18. The developing blade 12 extends substantially in parallel to the rotational axis direction of the developing sleeve 18. In this embodiment, the developing blade 12 is a separate member from the developing container 11, and is attached to the developing container 11 with an adhesive.

The developing device 4 feeds the developer from the inside of the developing chamber 11*a* to a developing portion (developing region) where the developing sleeve 18 and the photosensitive drum 1 closely oppose each other, so that the toner is deposited on the electrostatic latent image on the photosensitive drum 1. The developing sleeve 18 feeds the developer from the developing chamber 11*a* to the developing portion through the developing opening 11*c*. Further, the developing sleeve 18 collects the developer from the developing portion to the developing chamber 11*a* through the developing opening 11*c*. Constitutions of the developing sleeve 18, the magnet roller 19 and the developing blade 12, and a developing opening will be described later further specifically.

In this embodiment, the developing container 11 is constituted principally by first, second and third frames 31, 32 and 33 and end portion members (not shown) provided on a front side and a rear side on the drawing sheet of FIG. 3. The first frame 31 principally forms the developing chamber 11*a*, a bottom of the stirring chamber 11*b*, one edge portion of the developing opening 11*c* and the partition wall 17. The second frame 32 principally forms a cover of the stirring chamber 11*b*. The third frame 33 not only forms the other edge portion of the developing opening 11*c* but also constitutes a holding member of the developing blade 12. The developing blade 12 is fixed to the third frame 33 by bonding or fastening.

As regards the developer passed through the developing portion and collected in the developing chamber 11*a*, the toner in an amount depending on an output image is consumed. For that reason, there is a need that the toner in an amount corresponding to an amount of the consumed toner is supplied and thus the toner content of the developer in the developing container 11 is maintained substantially constant. The stirring chamber 11*b* is provided with a supply opening 14 which is an opening for permitting supply of the toner to the developing container 11. The supply opening 14 is provided in an upper-side wall portion (second frame 32) in the neighborhood of an upstream end portion in the stirring chamber 11*b* with respect to a developer feeding direction. With the supply opening 14, a toner cartridge 50 (FIG. 1) as a supply container is connected. Then, the toner is supplied from the toner cartridge 50 into the stirring chamber 11*b* through the supply opening 14.

In this embodiment, a toner consumption amount is estimated from output image information, and a toner supply amount is set at the same value as that of the toner consumption amount. On the basis of a detection result of the toner content of the developer in the stirring chamber 11*b*, the toner supply amount based on the toner consumption amount is finely adjusted.

3. Developing Sleeve, Magnet Roller and Developing Blade

The developing sleeve 18 is a cylindrical member formed of a non-magnetic material. A surface of the developing sleeve 18 has been subjected to a process (blasting or grooving) for increasing function with the developer. The developing sleeve 18 feeds the developer, contained on its surface by a magnetic force of the magnet roller 19, by a frictional force. In this embodiment, the developing sleeve 18 is, as shown by an arrow R3 in FIG. 3, rotationally driven in a direction in which the surface of the photosensitive drum 1 and the surface of the developing sleeve 18 more in the same direction at their opposing positions.

The magnet roller 19 includes a plurality of magnetic poles with respect to a circumferential direction. The magnetic poles of the magnet roller 19 are used for carrying the developer on and peeling the developer from the developing sleeve 18. For convenience, with respect to the circumferential direction of the developing sleeve 18, a position closest to each of the magnetic poles of the magnet roller 19 on an outer peripheral surface of the developing sleeve 18 will be described as a position of the associated magnetic pole in some cases. As regards magnetic poles S1, S2, S3, N1 and N2 described below, "S" and "N" represent an S pole and an N pole, respectively. Further, "upstream" and "downstream" relating to the magnetic poles mean those with respect to a rotational direction of the developing sleeve 18.

The developer in the developing chamber 11*a* is carried on the developing sleeve 18 by a magnetic force of a draw-up pole S2. At a position downstream of the draw-up pole S2 and substantially opposing the developing blade 12, a cut pole N1 is provided. When the developer carried on the developing sleeve 18 passes through an opposing portion between the developing blade 12 and the developing sleeve 18 and is fed toward an outside of the developing chamber 11*a*, an amount of the developer is regulated. At a position downstream the cut pole N1 and substantially opposing the photosensitive drum 1, a developing pole S1 is provided. The developer carried on the developing sleeve 18 is raised by the magnetic force of the developing pole S1 and forms a magnetic chain (magnetic brush), and then contacts the photosensitive drum 1. Then, depending on the electrostatic latent image on the photosensitive drum 1, the toner is moved (jumped) from the developer on the developing sleeve 18 onto the photosensitive drum 1 by an electrostatic force, and is deposited on an image portion of the electrostatic latent image. The developer after passing through the developing portion is fed into the developing chamber 11*a*, while being carried on the developing sleeve 18, by the magnetic force of a feeding pole N2 positioned downstream of the developing pole S1. The developer fed into the developing chamber 11*a* is separated from the developing sleeve 18 and is returned into the developing chamber 11*a* by the action of a peeling (separating) pole S3 positioned downstream of the feeding pole N2 and the draw-up pole S2 which has the same polarity of the peeling pole S3.

In this embodiment, the developing blade 12 is formed using a resin material. A constitution and action of this resin-made resin material will be described later further specifically.

Figure 4:
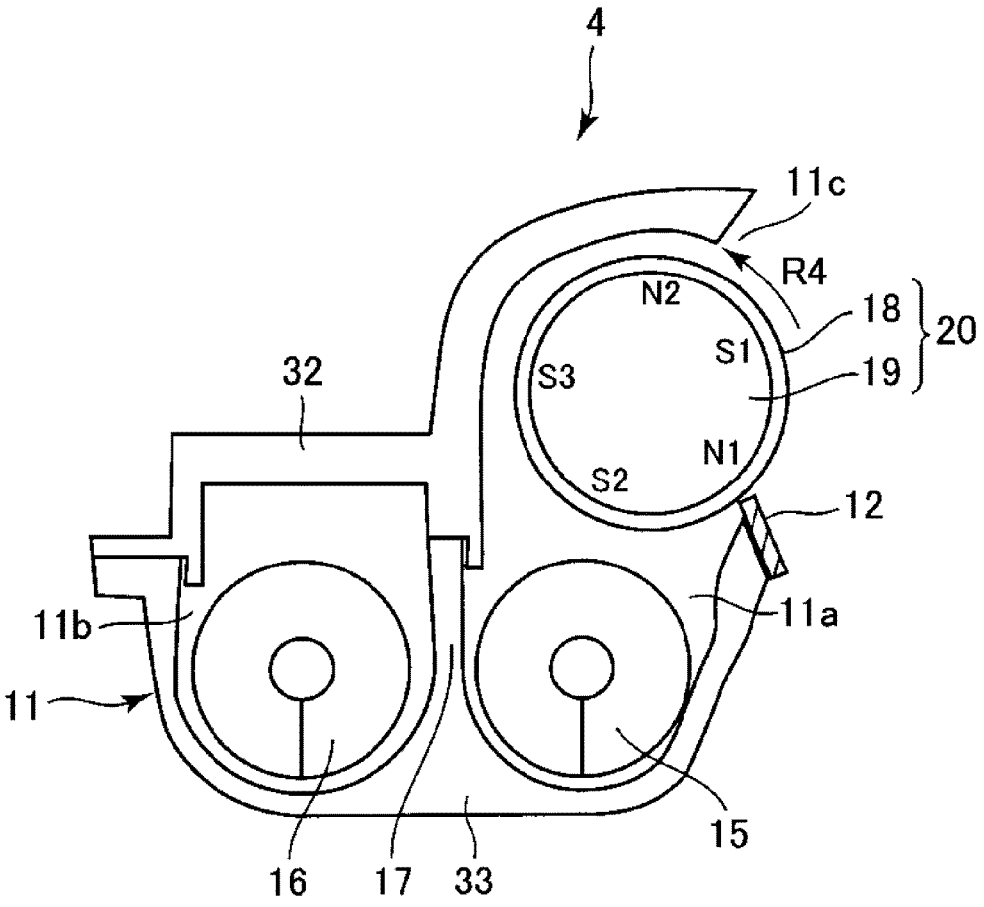
FIG. 4 is a sectional view of another example of the developing device.

In this embodiment, as shown in FIG. 3, the developing blade 12 is disposed above the developing sleeve 18, but as shown in FIG. 4, the developing blade 12 may also be disposed below the developing sleeve 18. In an example shown in FIG. 4, as indicated by an arrow R4 in the figure, the developing sleeve 18 is rotationally driven in a direction in which the surface of the photosensitive drum 1 and the surface of the developing sleeve 18 move in opposite directions to each other at the developing portion. Further, in the example shown in FIG. 4, the developing container 11 is constituted by the first and second frames 31 and 32 and end portion members (not shown) provided on a front side and a rear side on the drawing sheet of FIG. 4. The first frame 31 principally not only forms bottoms of the developing chamber 11*a* and the stirring chamber 11*b* and one end portion of the developing opening 11*c* but also constitutes a holding member for the developing blade 12. The second frame 32 principally forms a cover of the stirring chamber 11*b* and the other end portion of the developing opening 11*c*.

4. Problem of Resin-Made Regulating Member

The amount of the developer fed to the developing portion is stabilized by the action of the cut pole N1 and the developing blade 12. Incidentally, the amount of the developer carried and fed to the developing portion by the developing sleeve 18 is represented by a weight per unit area thereof on the developing sleeve 18 and is also simply referred to as a "carrying amount M/S". The developing blade 12 is positioned in a region in which the developer is raised by the magnetic force of the cut pole N1 and forms the magnetic chain, and is disposed at a free end thereof. Between the free end of the developing blade 12 and the outer peripheral surface of the developing blade 18, the magnetic chain raised so as to follow magnetic lines of force of the cut pole N1 is caused to pass through, so that a length of the magnetic chain is regulated and thus the carrying amount M/S is regulated. A gap (interval) between the free end of the developing blade 12 and the outer peripheral surface of the developing sleeve 18 is also referred to as an "SB gap", and a distance (shortest distance) of the gap is also referred to as a "SB gap G". That is, the carrying amount M/S is determined by an angle of the chain of the developer raised by the cut pole N1 and by the SB gap G.

Conventionally, the developing blade 12 is constituted in many cases by a plate-like member formed of a metal material, such as aluminum alloy or stainless steel, as a non-magnetic material. On the other hand, in this embodiment, the developing blade 12 is formed using the resin material. By forming the developing blade 12 with the resin material, there are advantages such that compared with the case where the developing blade 12 is formed of the metal material, a material cost is easily reduced and a manufacturing cost of the developing device 4 can be suppressed. However, the resin-made developing blade 12 is liable to be lower in rigidity compared with the metal-made developing blade 12. For example, Young's modulus of stainless steel which is an example of the metal material is about 199 GPa, whereas Young's modulus of polycarbonate which is an example of the resin material is about 2.4 GPa. For that reason, as regards the resin-made developing blade 12, distortion and deflection and the like due to an external force are problematic.

Further, the developing device 4 is fixed to a casing of the image forming apparatus 100 at both end portions thereof with respect to a longitudinal direction and is assembled in the apparatus main assembly of the image forming apparatus 100. For that reason, in the case where deviation generates in the casing of the image forming apparatus 100 or in the like case, a twist generates in the developing device 4 in some instances. This twist is liable to generate with the developing sleeve 18 as an axis, and therefore, a deviation of a relative positional relationship between the developing blade 12 and the developing sleeve 18 is liable to generate as a deviation of the rotational direction with the developing sleeve 18 as the axis. Further, by the influence of a pressure of the developer, exerted on the developing blade 12 during drive of the developing device 4, the deflection is liable to generate at a longitudinal central portion of the developing blade 12. Regulation of the developer by the developing blade 12 is carried out with respect to the rotational direction of the developing sleeve 18, and therefore, also this deflection is liable to generate as a deviation of the rotational direction with the developing sleeve 18 as the axis.

As described above, the carrying amount M/S is determined by the angle of the chain of the developer raised by the cut pole N1 and the SB gap G. In the case where with respect to the rotational direction of the developing sleeve 18, the deviation of the relative positional relationship between the developing blade 12 and the developing sleeve 18 generates, so that a degree of raising of the magnetic chain in the SB gap changes. For that reason, the carrying amount M/S changes and thus a developing property at the developing portion changes. As a result, an output image is influenced, so that density non-uniformity principally of the output image generates with respect to a direction (substantially perpendicular to the feeding direction) substantially parallel to the longitudinal direction of the developing blade 12. In the case where the carrying amount M/S excessively increases, there is a possibility that an inside of the casing of the image forming apparatus 100 is contaminated with the developer by the presence of the developer at the developing portion or a position where the developer is collected in the developing container 11 after development.

Thus, as regards the resin-made developing blade 12, a latitude (pole position latitude) with respect to a deviation of a relative positional relationship (pole position) between the developing blade 12 and the cut pole N1 is liable to become lower than that in the case of the metal-made developing blade 12.

5. Magnetic Resin-Made Regulating Member

In this embodiment, in view of the above-described problem, at least a part of the developing blade 12 is formed of a resin material containing magnetic powder (hereinafter also referred to as a "magnetic resin material"). A substantial entirety of the developing blade 12 may also be formed of the magnetic resin material, but a portion falling within a range in which the magnetic force is sufficiently exerted by at least the cut pole N1, i.e., within a range in which contribution of the magnetic field of the cut pole N1 is sufficiently large, may only be required to be formed of the magnetic resin material. As a result, in the neighborhood of the developing blade 12, the direction of the magnetic lines of force is fixed to the developing blade 12, and therefore, even when the relative positional relationship between the developing blade 12 and the cut pole N2 deviates, the direction of the magnetic lines of force in the neighborhood of the SB gap does not readily change. For that reason, the latitude with respect to the deviation of the relative positional relationship between the developing blade 12 and the cut pole N1 can be improved. That is, even when the relative positional relationship between the developing blade 12 and the cut pole N1 deviates, a change in carrying amount M/S can be suppressed.

In this embodiment, the substantial entirety of the developing blade 12 is formed of the magnetic resin material. In this embodiment, the developing blade 12 is the plate-like member which has predetermined lengths with respect to the longitudinal direction substantially parallel to the rotational axis direction of the developing sleeve 18 and with respect to a short-side direction substantially perpendicular to the longitudinal direction and which has a predetermined thickness. In this embodiment, the free end of the developing blade 12 with respect to the short-side direction on the developing sleeve 18 side has a flat surface extending substantially in parallel to a surface movement direction of the developing blade 21. The free end of the developing blade 12 with respect to the short-side direction on the developing sleeve 18 side has a length (thickness) with respect to a direction substantially parallel to the surface movement direction of the developing blade 12 may suitably be about 1 mm-5 mm, and was 2 mm in this embodiment. Incidentally, the thickness of the developing blade 12 may be different between the free end portion on the developing sleeve 18 side and a position remoter from the developing sleeve 18 than the free end portion (FIG. 6). The thickness of the free end of the developing blade 12 with respect to the short-side direction on the developing blade 18 side is made relatively thin as described above, and on the other hand, in order to ensure sufficient rigidity of the developing blade 12, the thickness of the developing blade 12 at the position remoter from the developing sleeve 18 than the free end is can be made relatively thick.

The developing blade 12 can be manufactured by mixing a binder resin material and magnetic powder (magnetic fine particles) in a desired amount ratio, by forming a magnetic resin material through kneading the mixture at an appropriate temperature with use of heat-fusing mixing device such as a three-roll mill or an extruding machine, and by subjecting the magnetic resin material to injection molding. In this embodiment, as the binder resin material, polycarbonate which was the same material as the material constituting the developing container 11 was used. The binder resin material is not limited thereto but may appropriately be selected from the viewpoint such that a sufficient rigidity can be obtained. As the binder resin material, any resin material (synthetic resin material, plastics) ordinarily used as materials of constituent parts (elements) of the image forming apparatus can be suitably used. For example, in addition to the above-described polycarbonate, AS resin and ABS resin can be cited. In this embodiment, as the magnetic powder, manganese-based ferrite powder was used. The magnetic powder is not limited thereto, but may only be required to be appropriately selected from the viewpoint such that the selected material constitutes the magnetic resin material having preferred relative permeability described later. For example, in addition to the above-described manganese-based ferrite powder, nickel powder can be cited. Further, a particle size of the magnetic powder may be appropriately selected from the viewpoints of a dispersing property and ease of handling of the material powder in the binder resin material, but for example, magnetic powder of about 1 μm-500 μm in average particle size (primary particle size) can be suitably used.

In this embodiment, relative permeability p of the magnetic resin material constituting the developing blade 12 is 48. For measurement of the relative permeability μ, a vibrating sample magnetometer (VSM) was used. The USM used is a measuring system manufactured by Riken Denshi Co., Ltd. Incidentally, a value of the relative permeability μ is an average of a measurement result (10 points) of a plurality of samples.

Here, magnetic analysis about a state of magnetic lines of force in the case where the developing blade 12 formed of the magnetic resin material in this embodiment was used was carried out. A condition of the analysis is as follows. The relative permeability μ of the developing blade 12 is 48, the SB gap G is 300 μm, and magnetic field strength (a value at a center of a movement direction of the developing sleeve 18 on the outer peripheral surface of the developing sleeve 18) generated by the cut pole N1 is 65 mT. In this embodiment, a nominal position of the cut pole N1 is a position of 5° upstream of the position thereof closest to the developing blade 12, and an error of the position of the cut pole N1 is estimated as ±5°. Incidentally, the position of the cut pole N1 is represented by a positive value (e.g., +5°) when an angular position of the cut pole N1 is on an upstream side relative to the developing sleeve 18, and is represented by a negative value (e.g.,)−5° when the angular position is on a downstream side relative to the developing sleeve 18. Further, a calculation was carried out using relative permeability of air as 1. The analysis was conducted by calculating the magnetic field through a dipole superposition method using a finite element method.

Parts (a) to (d) of FIG. 6 show an example of concentration of the magnetic lines of force in the above-described analysis. Parts (a) and (b) of FIG. 6 show an analysis result in the case where the developing blade 12 formed of the magnetic resin material in this embodiment was used, and parts (c) and (d) of FIG. 6 show an analysis result in the case where the developing blade 12 formed of a resin material containing on magnetic powder (herein also referred to as a "non-magnetic resin material"). Parts (a) and (c) of FIG. 6 show the analysis results in the case where the cut pole N1 in the position of +5°, and parts (b) and (d) of FIG. 6 show the analysis results in the case where the cut pole N1 is in the position of −5°. As regards the developing blade 12 formed of the non-magnetic resin material, other constitutions are substantially the same as those of the developing blade 12 formed of the magnetic resin material in this embodiment.

From FIG. 6, it is understood that the developing blade 12 formed of the magnetic resin material in this embodiment concentrates the magnetic lines of force, generated by the cut pole N1, at the surface of the free end of thereof compared with the developing blade 12 formed of the non-magnetic resin material. Further, it is understood that in the developing blade 12 formed of the magnetic resin material in this embodiment, a difference in slope of the magnetic lines of force in the SB gap in the case where the position of the cut pole N1 is changed is small. Thus, it is understood that as regards the developing blade 12 formed of the magnetic resin material, a latitude with respect to the deviation of the relative positional relationship between the developing blade 12 and the cut pole N1 is larger than that of the developing blade 12 formed of the non-magnetic resin material.

Here, as described above, the developing blade 12 may only be required that a portion positioned in a range in which at least the cut pole N1 applies the magnetic force is formed of the magnetic resin material. By the same analysis as described above, the range was checked. As a result, it was understood that in order to effectively concentrate the magnetic lines of force of the cut pole N1, the magnetic material is desired that the strength of the magnetic field generated by the cut pole N1 falls within a range not less than 1/10 of the magnetic field strength on the outer peripheral surface of the developing sleeve 18. That is, the portion (region) of the developing blade 12 in the range (position) in which the strength of the magnetic field generated by at least the cut pole N1 is not less than 1/10 of the magnetic field strength on the outer peripheral surface of the developing sleeve 18 may preferably be formed of the magnetic resin material. Typically, the above-described portion (region) of the developing blade 12 is a portion (region) falling within a range of several mm (e.g., about 5 mm or less). Accordingly, for example, only a portion containing the free end of the developing blade 12 on the developing sleeve 18 side with respect to the short-side direction may be formed of the magnetic resin material, and another portion may be formed of the non-magnetic material.

6. Suppression of Toner Deterioration

Figure 5:
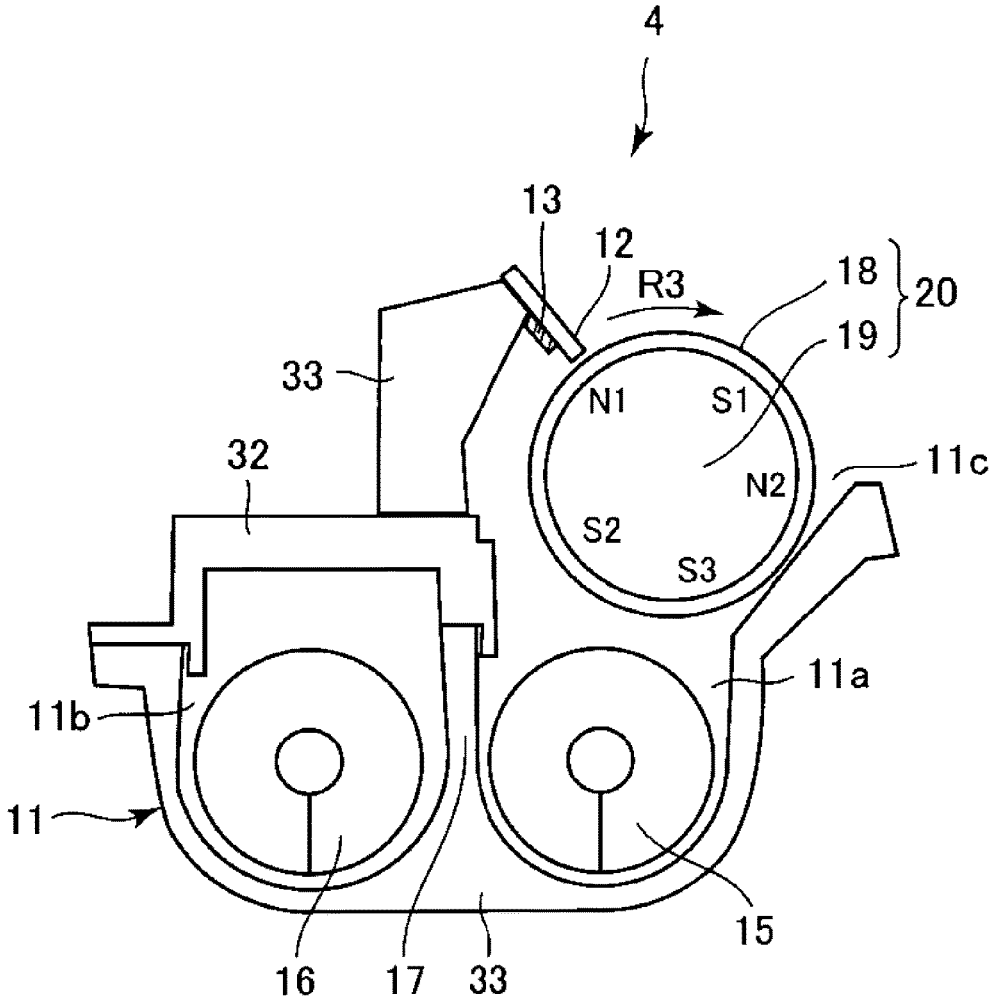
FIG. 5 is a sectional view of a developing device in a comparison example.

As another constitution for suppressing the change in carrying amount M/S due to the change in relative positional relationship between the developing blade 12 and the cut pole N1 as described above, a constitution in which the magnetic plate 13 is disposed in the neighborhood of the developing blade 12 as shown in FIG. 5 would be considered. When the magnetic plate 13 is disposed in the neighborhood of the developing blade 12, the magnetic lines of force extend perpendicular at the surface of the magnetic plate 13, and therefore, even when the position of the cut pole N1 somewhat changes, a degree of the change in magnetic lines of force in the neighborhood of the developing blade 12 becomes small. However, when the magnetic plate 13 is disposed in the neighborhood, excessive magnetic field concentration occurs at the magnetic plate 13, so that a load on the developer increases in some cases. As a result, deterioration of the toner in the developer is promoted, so that an image defect (such as a rough (crumbling) image) due to the toner deterioration is caused. Further, in the image forming apparatus in which an operation of discharging the toner from the developing device 4 onto the photosensitive drum 1 (toner discharge) is performed by, e.g., forming a band-like image periodically during non-image formation, the toner deterioration leads to an increase of a toner discharge amount.

On the other hand, according to this embodiment, when the resin material constituting the developing blade 12 is prepared, the magnetic powder in an appropriate amount is mixed and kneaded in the resin material, whereby the relative permeability is readily controlled. For that reason, according to this embodiment, it is easy to realize both of ensuring of (magnetic) pole position latitude of the cut pole N1 and suppression of the excessive toner deterioration.

Here, evaluation of the toner deterioration in the case where the developing blade 12 formed of the magnetic resin material in this embodiment was used was made in the following manner. A durability test was conducted in an environment of a temperature of 23° C. and a relative humidity of 50% RH by using an image forming apparatus ("image RUNNER ADVANCE C350F", manufactured by Canon K.K.). The toner deterioration is liable to generate in the case where an image with a low image density was continuously outputted, and therefore, the image with the image density (print ratio, image duty) of 0% was outputted on 5000 sheets of A4-sized paper. After the output of the image, a BET specific surface area of the toner remaining in the developing container 11 was measured. The toner deterioration generates principally due to disappearance of an external additive on the toner surface, and therefore, was evaluated by a change in BET specific surface area. For measurement, a measuring device (Quadrasorb SI", manufactured by Quantachrome Instruments Japan G.K.) was used. A result is shown in FIG. 7. In FIG. 7, "MR (magnetic resin material") show a result of this embodiment. As a comparison example, a similar test was conducted also as to the case where the developing blade 12 was formed of a non-magnetic metal material ("MB (metal blade)" in FIG. 7) and the case where the developing blade 12 is formed of the non-magnetic metal material and the magnetic plate is mounted on the developing blade 12 ("MB+MP (magnetic plate)" in FIG. 7. As the non-magnetic metal material, SUS (stainless steel) was used, and as the material of the magnetic plate, a SPCC material (cold rolled steel plate) was used.

From FIG. 7, it is understood that in the constitution ("MR (magnetic resin material)") in this embodiment, a degree of the toner deterioration is suppressed more than the case of "MB+MP" and can be made comparable to the case of "MB". That is, according to this embodiment, it is possible to suppress the degree of the toner deterioration more than the constitution in which the developing blade 12 is formed of the non-magnetic metal material and is provided with the magnetic plate.

Thus, according to this embodiment, it becomes possible to realize both of the ensuring of the pole position latitude of the cut pole N1 and the suppression of the excessive toner deterioration.

7. Relative Permeability of Magnetic Resin Material-Made Regulating Member

Preferred relative permeability of the developing blade 12 formed of the magnetic resin material will be described.

First, the case where the relative permeability of the developing blade 12 formed of the magnetic resin material is high will be described. In the case where the relative permeability is high, the magnetic force exerted on the developing blade 12 increases. In that case, there is a possibility that in addition to the above-described toner deterioration, the developing blade 12 itself having the magnetic property is attracted to the magnet roller 19 and is deformed.

Here, the metal-made developing blade 12 and the resin-made developing blade 12 which have the same shape will be compared with each other. In the above-described constitution ("MB+MP") in which the developing blade 12 is formed of the non-magnetic metal material and the magnetic plate is mounted on the developing blade 12, deformation of the developing blade 12 due to the material force is not generated. Therefore, a relationship between rigidity of the developing blade 12 formed of the non-magnetic metal material and the magnetic force exerted from the cut pole N1 on the magnetic plate will be considered as a reference. As the metal material, a general-purpose SUS plate material (SUS304, Young's modulus: about 199 GPa, non-magnetic) was used, and as the resin material, polycarbonate (Young's modulus: about 2.4 GPa) was used. The resin-made developing blade 12 has a beam shape such that both end portions thereof with respect to the longitudinal direction are fixed. Accordingly, in the case where a magnetic force $F_{N1}$ by the cut pole N1 is uniformly exerted on the entire region of the developing blade 12 with respect to the longitudinal direction, a deflection amount $\delta_c$ at a central portion with respect to the longitudinal direction is obtained by the following formula.

$$\delta_c = \frac{F_{N1} l^4}{384EI}$$

In the above formula, l is a length with respect to the longitudinal direction, E is the Young's modulus, and I is geometrical moment of inertia. That is, in the case of the same shape, the length l with respect to the longitudinal direction and the geometrical moment of inertia I are the same, and therefore, the central deflection amount $\delta_c$ is proportional to the magnetic force $F_{N1}$ exerted from the cut pole N1 and is inversely proportional to the Young's modulus E of the developing blade 12. The magnetic force $F_{N1}$ by the cut pole N1 is obtained by the following formula.

$$F_{N1} = \frac{IB}{\sin\theta} = \frac{\mu IH}{\sin\theta}$$

In the above formula, I is a current generated by electron spin, and H is strength of the magnetic field. The magnetic force $F_{N1}$ by the cut pole N1 is proportional to the relative permeability p and the magnetic field strength H. In general, with a stronger magnetic field generated by the cut pole N1, a degree of the toner deterioration due to a load during image formation is more promoted. For that reason, usually, the magnetic field strength H of the cut pole N1 is suppressed to a minimum necessary level. As a result, the longitudinal central deflection amount $\delta_c$ of the developing blade 12 is proportional to the relative permeability μ of the member and is reversely proportional to the Young's modulus.

$$\delta_c \propto \frac{\mu}{E}$$

Here, typically, as the material of the magnetic plate 13, an iron material (SPCC material or the like) is used. The relative permeability μ of a general-purpose iron material is 5,000. FIG. 8 is a graph showing a relationship between the relative permeability of the magnetic member mounted on the developing blade 12 and the deflection amount of the developing blade 12, in which the abscissa represents the relative permeability, and the ordinate represents the deflection amount. From FIG. 8, it is understood that in order to make the deflection amount the same or less in the constitution in which the magnetic plate (iron material) is mounted on the non-magnetic material (SUS)-made developing blade 12, the relative permeability μ of the magnetic member mounted on the resin (polycarbonate)-made developing blade 12 may preferably be 60 or less.

The resin-made developing blade 12 is easily upsized compared with the metal-made developing blade 12, and therefore, rigidity is easily ensured by the shape thereof. However, in the case where the magnetic property is imparted to the resin-made developing blade 12, suppression of the relative permeability μ to 60 or less is safe since the deflection of the resin-made developing blade 12 can be suppressed with reliability.

As described above, an average of the relative permeability μ of the developing blade 12 formed of the magnetic resin material (i.e., the portion formed of the magnetic resin material) may preferably be 60 or less.

Next, the case where the relative permeability of the developing blade 12 formed of the magnetic resin material is low will be described. In the case where the relative permeability is low, concentration power of the magnetic lines of force lowers, so that there is a possibility that the advantage of the use of the magnetic resin material is not sufficiently obtained.

Here, using the magnetic field analysis, a state of the magnetic lines of force when the relative permeability is changed is compared. The analysis was performed by calculating the magnetic field through the dipole superposition method using the finite element method. The calculation was carried out in condition such that the SB gap G was 300 μm and the magnetic field strength generated by the cut pole N1 was 65 mT. The analysis was performed in the case where the relative permeability was 50 and in the case where the relative permeability was 1.

As described above, the regulation of the carrying amount M/S by the developing blade 12 is carried out by raising the developer depending on the direction of the magnetic lines of force generated by the cut pole N1 and then by causing the developer to pass through the SB gap. For that reason, in the SB gap, the angle of the magnetic lines of force and the carrying amount M/S are proportional to each other. The angle of the magnetic lines of force is substantially determined by a component Br, of magnetic flux density B generated by the cut pole N1, with respect to a rotation center direction (normal direction) of the developing sleeve 18 and by a component Bθ, of the magnetic flux density B, with respect to the rotational direction of the developing sleeve 18. For that reason, the components Bθ and Br and the carrying amount M/S satisfy the following relationship.

$$M/S \propto G \times \tan\frac{B_\theta}{B_r}$$

In this embodiment, a change amount of the carrying amount M/S with respect to the pole position in the case where the pole position of the cut pole N1 changes in a range of setting center ±5° (usually estimated manufacturing error of the pole position of the magnet roller) is checked. That is, from a difference in slope of the magnetic chain in the case where such a change generates, a change amount ΔM/S of the carrying amount M/S is estimated by the following formula.

$$\Delta M/S \propto \left|\left(\tan\frac{B_\theta}{B_r}\right)_{+5^\circ} - \left(\tan\frac{B_\theta}{B_r}\right)_{-5^\circ}\right|$$

In the above formula, numeric (symbolic) subscripts represent deviation angles from a design center position of the cut pole N1. A result is shown in FIG. 9. From FIG. 9, it is understood that in the case where the relative permeability increases from 1 (no magnetic property), the change amount ΔM/S of the carrying amount M/S decreases toward about 10. This world is considered because the magnetic material causes the magnetic lines of force of the cut pole n1 to concentrate at the surface of the free end of the developing blade 12. When the relative permeability exceeds 20, the change amount ΔM/S of the carrying amount M/S is saturated and stabilized. That is, an average of the relative permeability μ of the magnetic resin material-made developing blade 12 (the portion formed of the magnetic resin material) may preferably be 10 or more, further preferably be 20 or more. As a result, the magnetic material is effectively used, so that the change amount ΔM/S of the carrying amount M/S is made small and thus can be stabilized.

Here, a magnitude of the magnetic flux density at a point remote from the magnetic pole by r is represented by the following formula.

$$B = \frac{1}{4\pi\mu_0}\frac{M}{r^2}$$

In the above formula, $\mu_0$ is vacuum (space) relative permeability, M is magnetic field strength (a value at a center of the developing sleeve with respect to a movement direction on the outer peripheral surface of the developing sleeve in this embodiment) (mT) generated by the magnetic pole, and r is distance (μm) from the magnetic pole (a position, on the outer peripheral surface of the developing sleeve, closest to the magnetic pole in this embodiment).

As described above, in the case where the magnetic field strength of the cut pole N1 was 65 mT as a center value, the SB gap G was 300 μm, and the deviation angle θ of the cut pole N1 from the developing blade 12 was 5°, the average of the relative permeability μ was preferably 10 or more, further preferably 20 or more. The distance r is obtained from the SB gap G and the deviation angle θ of the cut pole N1 from the developing blade 12, by the following formula.

$$r = \frac{G}{\cos\theta}$$

In the case where the magnetic flux density of the cut pole N1 is further small, when a desire to increase the relative permeability in order to further concentrate the magnetic flux is taken into consideration, the above condition can be replaced with the following condition.

$$\mu \geq 7.8\times10^{-3}\times\frac{r^2}{M}$$

As described above, the average of the relative permeability μ of the magnetic resin material-made developing blade 12 (the magnetic resin material-made portion) may preferably be $7.8\times10^{-3}\times(r^2/M)$.

8. Comparison Test

A verification experiment in which the change amount ΔM/S of the carrying amount M/S with respect to the position of the cut pole N1 is compared between the constitution of this embodiment in which the developing blade 12 formed of the magnetic resin material was used and the constitution of the comparison example in which the developing blade 12 formed of the non-magnetic resin material was used. The verification experiment was conducted in an environment of 23° C. in temperature and 50% RH in relative humidity. As the regulating member in the constitution of this embodiment, the regulating member obtained by replacing the regulating member in the developing device of the image forming apparatus ("image RUNNER ADVANCE C350F, manufactured by Canon K.K.) with the developing blade 12 in this embodiment was used. Further, as the regulating member in the constitution of the comparison example, the regulating member obtained by replacing the regulating member in the developing device of the image forming apparatus ("image RUNNER ADVANCE C350F") with the developing blade 12 formed of a material excluding the magnetic powder from the material in this embodiment was used. In either case of this embodiment and the comparison example, constitutions other than the developing device are those of the above-described image forming apparatus as they are. The pole position of the cut pole N1 was changed by ±5° with respect to the normal position (the position of 5° from the position closest to the developing blade 12) toward the upstream side, and the change amounts ΔM/S of the carrying amounts M/S were compared with each other. For measurement of the carrying amount M/S, the developer on the developing sleeve 18 was sampled using a magnet, and a weight of the sample and a sampling area were measured, so that the carrying amount was obtained. A result is shown in FIG. 10.

From FIG. 10, it is understood that in the constitution of this embodiment, the change in carrying amount M/S with respect to the change in position of the cut pole N1 is smaller than that in the constitution of the comparison example. In the constitution in the comparison example, ΔM/S was 6 g/cm$^2$. On the other hand, in the constitution in this embodiment, ΔM/S was 2 g/cm$^2$. Thus, in the constitution in this embodiment, compared with the constitution of the comparison example, a latitude with respect to the deviation of the relative positional relationship between the developing blade 12 and the cut pole N1 was improved.

As described above, in this embodiment, at least the part of the developing blade 12 is formed of the material obtained by mixing and kneading the resin material with the magnetic powder. As a result, even in the case where the resin-made developing blade 12 is used, it is possible to suppress the change in carrying amount M/S due to the deviation of the relative between the developing blade 12 and the cut pole N1. For that reason, while realizing an inexpensive constitution compared with the constitution using the metal-made developing blade 12, it is possible to suppress the generation of the image defect due to the change in carrying amount and to suppress contamination of the inside of the image forming apparatus 100 with the developer due to an overflow of the developer by an excessive increase in carrying amount. Further, by setting the relative permeability of the magnetic resin material-made developing blade 12 in a preferred range, the pole position latitude can be effectively improved while the deflection amount of the resin-made developing blade 12 is kept equivalent to that of the metal-made developing blade 12.

Embodiment 2

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those of the image forming apparatus in Embodiment 1 are represented by the same reference numerals or symbols and will be omitted from description.

FIG. 11 is a sectional view of a developing device 4 in another embodiment of the present invention. In this embodiment, similarly as in Embodiment 1, the developing container 11 is constituted principally by the first, second and third frames 31, 32 and 33 and end portion members (not shown) provided on a front side and a rear side of the drawing sheet of FIG. 11. In this embodiment, the third frame 33 constituting the holding member of the developing blade 12 in Embodiment 1 functions as the regulating member and is provided with a regulating portion 33*a* projecting toward the developing blade 18 at a position opposing the developing sleeve 18. That is, in this embodiment, the regulating member is constituted integrally with a member constituting at least a part of the developing container 11. A free end of the regulating portion 33*a* on the developing sleeve 18 side has a shape similar to the shape of the free end of the developing blade 12 on the developing sleeve 18 side in Embodiment 1. Further, the regulating portion 33*a* opposes the developing sleeve 18 through an SB gap G similar to the SB gap G in Embodiment 1. Further, in this embodiment, a nominal position of the cut pole N1 with respect to the regulating portion 33*a* is set similarly as in Embodiment 1.

In this embodiment, an entirety of the third frame 33 including the regulating portion 33*a* is formed of the resin material (magnetic resin material) containing the magnetic powder described in Embodiment 1. In this embodiment, similarly as in Embodiment 1, the relative permeability μ of the magnetic resin material constituting the third frame 33 is 48. Thus, the regulating member formed integrally with the member constituting the developing container 11 is formed of the magnetic resin material, so that an effect similar to that of Embodiment 1 can be obtained.

In this embodiment, the third frame 33 constituting the regulating member may desirably be fixed to other members (end portion members supporting the both end portions of the developing sleeve 18 with respect to the longitudinal direction in this embodiment) constituting the developing container 11 by bonding with a UV-curable resin material or the like. This is because distortion due to fixing is liable to generate in the case of fixing with a fastening means such as a screw. In this embodiment, the fixing of the third frame 33 was carried out using epoxyacrylate which is an epoxy UV-curable resin material. In this embodiment, the UV-curable resin material was applied between the third frame 33 and the end portion members supporting the end portions of the developing sleeve 18 with respect to the longitudinal direction. Then, after the SB gap G was determined, UV irradiation was carried out, and thus the third frame 33 was fixed to the end portion members. In this way, the third frame 33 was fixed using the UV-curable resin material, so that a twist or the like in the case where the third frame 33 is fixed with the fastening means can be suppressed.

Incidentally, in this embodiment, an entirety of the third frame constituting the regulating member assumes the magnetic property. However, a portion, of the third frame 33, other than the regulating portion 33*a* is spaced from the developing sleeve 18, and therefore, the regulation of the developer is not influenced. That is, in this embodiment, the range in which the magnetic field strength generated by the cut pole N1 is not less than 1/10 of the magnetic field strength on the outer peripheral surface of the developing sleeve 18 is a range of about 2 mm from the outer peripheral surface of the developing sleeve 18, and within this range, only the regulating portion 33*e* exists.

In this embodiment, similarly as in Embodiment 1, the regulating member is disposed above the developing sleeve 18, but as shown in FIG. 12, the regulating member may also be disposed below the developing sleeve 18. In an example shown in FIG. 12, the developing container 11 is constituted by the first and second frames 31 and 32 and end portion members (not shown) provided on a front side and a rear side on the drawing sheet of FIG. 12. Further, the first frame 31 is provided with a regulating portion 31*a* which functions as the regulating member and which projects toward the developing sleeve 18 at a position opposing the developing sleeve 18. That is, the regulating member can be constituted integrally with the beam-shaped member (FIG. 11) or the container-shaped member (FIG. 12), which constitute at least a part of the developing container 11. In the case of an example of FIG. 12, an entirety of the first frame 31 including the regulating portion 31*a* can be formed of the magnetic resin material described in Embodiment 1.

A verification experiment in which change amounts ΔM/S of carrying amounts M/S with respect to the cut pole N1 were compared between the constitution of this embodiment in which the third frame 33 was formed of the magnetic resin material and the constitution of a comparison example in which the third frame 33 was formed of the non-magnetic resin material was conducted. A method of the experiment is similar to that of the verification experiment described in Embodiment 1. As the regulating member in the constitution of this embodiment, the regulating member obtained by replacing the regulating member and its periphery (the developing blade and the holding member for holding the developing blade) in the developing device of the image forming apparatus ("image RUNNER ADVANCE C350F, manufactured by Canon K.K.) with the third frame 33 in this embodiment was used. Further, as the regulating member in the constitution of the comparison example, the regulating member obtained by replacing the regulating member and its periphery (the developing blade and the holding member for holding the developing blade) in the developing device of the image forming apparatus ("image RUNNER ADVANCE C350F") with the third frame 33 formed of a material excluding the magnetic powder from the material in this embodiment was used. In either case of this embodiment and the comparison example, constitutions other than the developing device are those of the above-described image forming apparatus as they are. The pole position of the cut pole N1 was changed by ±5° with respect to the normal position (the position of 5° from the position closest to the regulating portion 33*a*) toward the upstream side, and the change amounts ΔM/S of the carrying amounts M/S were compared with each other. A result is shown in FIG. 13.

From FIG. 13, it is understood that in the constitution of this embodiment, the change in carrying amount M/S with respect to the change in position of the cut pole N1 is smaller than that in the constitution of the comparison example. In the constitution in the comparison example, ΔM/S was 5 g/cm$^2$. On the other hand, in the constitution in this embodiment, ΔM/S was 1.6 g/cm$^2$. Thus, in the constitution in this embodiment, compared with the constitution of the comparison example, a latitude with respect to the deviation of the relative positional relationship between the regulating portion 33*a* and the cut pole N1 was improved.

Incidentally, in this embodiment, the entirety of the third frame 33 (the first frame 31 in the example of FIG. 12) was formed of the magnetic resin material. As another method, for example, only a frame portion which constitutes the regulating portion 33*a* (the regulating portion 31*a* in the example of FIG. 12) and which projects toward the developing sleeve 18 side (or only a portion containing a free end of the projected portion) may be formed of the magnetic resin material, and another portion may be formed of the non-magnetic resin material. As described in Embodiment 1, the portion of the regulating member, positioned in the range in which the magnetic field strength generated by at least the cut pole N1 is not less than 1/10 of the magnetic field strength, on the outer peripheral surface of the developing sleeve 18 may only be required to be formed of the magnetic resin material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-008868 filed on Jan. 20, 2017, which is hereby incorporated by reference herein in its entirety.

What is claimed is:

1. A developing device comprising:

a rotatable developer carrying member enclosing a magnetic field generating portion including a plurality of magnetic poles and configured to carry a developer; and a resinous regulating portion provided at a position opposing said developer carrying member and configured to regulate an amount of the developer carried by said developer carrying member, wherein said regulating portion is formed of a resin material containing magnetic powder, and at least a free end portion, opposed to said developer carrying member, of said regulating portion has relative permeability of 10 or more and 60 or less.

2. A developing device according to claim 1, wherein said regulating portion is a plate-shaped regulating member.

3. A developing device according to claim 1, further comprising a developer accommodating container configured to support said developer carrying member, wherein said regulating portion is integrally molded with said developer accommodating container.

4. A developing device according to claim 1, wherein a portion of said regulating portion, in a range of not less than 1/10 of a magnetic field on an outer peripheral surface of said developer carrying member opposing the magnetic pole closest to said regulating portion, is formed of a resin material containing the magnetic powder.

5. A developing device according to claim 1, wherein the relative permeability is not less than $7.8\times10^{-3}\times(r^2/M)$ where a magnetic field strength on the outer peripheral surface of said developer carrying member opposing the magnetic pole closest to said regulating portion is M (mT), and a distance between the outer peripheral surface and said regulating portion is r (μm).

6. A developing device according to claim 1, wherein at least the free end portion of said regulating portion has relative permeability of 20 or more.

* * * * *